US007600494B2

(12) United States Patent
Gale et al.

(10) Patent No.: US 7,600,494 B2
(45) **Date of Patent: *Oct. 13, 2009**

(54) OPERATION OF ELECTRICALLY ACTUATED VALVES AT LOWER TEMPERATURES

(75) Inventors: Allan Gale, Livonia, MI (US); Philip Koneda, Novi, MI (US); Clay Maranville, Ypsilanti, MI (US); Allan Kotwicki, Williamsburg, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 311 days.

This patent is subject to a terminal disclaimer.

(21) Appl. No.: 11/566,966

(22) Filed: Dec. 5, 2006

(65) Prior Publication Data

US 2008/0127919 A1 Jun. 5, 2008

(51) Int. Cl.
*F01L 9/04* (2006.01)

(52) U.S. Cl. ..... 123/90.11; 251/129.01; 251/129.16; 361/154

(58) Field of Classification Search ..... 123/90.11; 251/129.01, 129.15, 129.16; 361/152, 153, 361/154

See application file for complete search history.

(56) References Cited

U.S. PATENT DOCUMENTS

| | | | | |
|---|---|---|---|---|
| 3,601,110 | A | 8/1971 | Kamazuka | |
| 4,137,872 | A | 2/1979 | Loflin | |
| 4,934,907 | A | 6/1990 | Kroner | |
| 5,121,730 | A | 6/1992 | Ausman et al. | |
| 5,159,915 | A | 11/1992 | Saito et al. | |
| 5,201,341 | A | 4/1993 | Saito et al. | |
| 5,479,901 | A | 1/1996 | Gibson et al. | |
| 5,494,219 | A | 2/1996 | Maley et al. | |
| 5,752,308 | A | 5/1998 | Maley et al. | |
| 5,915,626 | A | 6/1999 | Awarzamani et al. | |
| 5,954,030 | A | 9/1999 | Sturman et al. | |
| 6,076,508 | A | 6/2000 | Nakano | |
| 6,192,868 | B1 | 2/2001 | Barnes et al. | |
| 6,257,499 | B1 | 7/2001 | Sturman | |
| 6,333,843 | B2 * | 12/2001 | Boie et al. | 361/140 |
| 6,392,865 | B1 | 5/2002 | Fochtman et al. | |
| 6,561,168 | B2 | 5/2003 | Hokao et al. | |
| 6,575,138 | B2 | 6/2003 | Welch et al. | |
| 6,799,559 | B2 | 10/2004 | Mieny et al. | |
| 6,820,856 | B2 | 11/2004 | Grill | |
| 2004/0011900 | A1 | 1/2004 | Gebhardt et al. | |
| 2005/0263136 | A1 | 12/2005 | Rigney | |

OTHER PUBLICATIONS

Applicants' Admission of Prior Art.
U.S. Appl. No. 11/566,911.
U.S. Appl. No. 11/566,890.
U.S. Appl. No. 11/566,932.
U.S. Appl. No. 11/566,981.
U.S. PTO Office Action, Mailed Feb. 6, 2008, U.S. Appl. No. 11/566,911 Examiner: Carl Miller, Art 3747.
U.S. PTO Office Action, Mailed: Sep. 13, 2007, U.S. Appl. No. 11/566,911, Examiner: Carl Miller, Art Unit 3747.

* cited by examiner

*Primary Examiner*—Ching Chang
(74) *Attorney, Agent, or Firm*—Allan J. Lippa; Alleman Hall McCoy Russell & Tuttle LLP

(57) ABSTRACT

A system and method for controlling electromechanical valves operating in an engine is presented. According to the method, valve operation can be improved by heating the valves, at least during some conditions.

14 Claims, 8 Drawing Sheets

OPERATION OF ELECTRICALLY ACTUATED VALVES AT LOWER TEMPERATURES

FIELD

The present description relates to a method for controlling electrically actuated valves operating in a cylinder of an internal combustion engine.

BACKGROUND AND SUMMARY

Internal combustion engine performance and emissions can be improved by employing variable event valvetrains. One type of variable event valvetrain uses electrically actuated valves to regulate gas flow into and out of cylinders of an engine. Operation of electrically actuated valves is not constrained by a physical connection to the crankshaft or camshaft. Therefore, the timing (opening and closing) of electrically operable mechanically actuated valves may be varied with engine operating conditions to improve engine performance, efficiency, and emissions. However, at cold operating temperatures, frictional losses in the electrically operable mechanically actuated valve increase non-linearly and additional electrical energy is necessary to operate a valve. Further, the increased mechanical viscous friction changes the valve response and can also increase the complexity of controlling valves under varying operating conditions.

One embodiment of the present description includes a method to improve the performance of an electrically actuated valve operable in an internal combustion engine, the method comprising: supplying a time-varying current to at least a coil of an electrically operable mechanical valve actuator that operates a valve of a cylinder of an internal combustion engine; said time varying current increasing eddy currents as temperature decreases; and said time varying current decreasing eddy currents as temperature increases.

Heating an electrically operable mechanically actuated valve can lower the electrical power necessary to overcome valve mechanical forces so that valve operation is improved, at least during some conditions. In one embodiment, a time-varying current may be passed through an actuator coil to create a time-varying magnetic field. This field can induce eddy currents and hysteresis losses in nearby metal components (e.g., in the valve actuator armature). The eddy currents are transformed into thermal energy as their flow is restricted by the metal armature. This thermal energy can raise the temperature of oil that lubricates the actuator armature outer surface, thereby reducing the oil viscosity. Consequently, the amount of energy necessary to operate the valve can be reduced as the oil viscosity is lowered by heating. In addition, valve heating can improve valve response and may make a valve respond more predictably.

The present description can provide several advantages. For example, the approach can be used to reduce the amount of power consumed by valves during valve state transitions. Also, the method can allow valves to be heated before an operator requests a vehicle start, which may reduce engine starting time. In addition, valves may be heated in a variety of ways so that a specific heating method may be selected based on the geometry of an electrically operable mechanically actuated intake or exhaust valve, for example. Further, in some embodiments, heating may be targeted to specific areas of an electrically operable mechanical valve actuator so that energy may be used more efficiently. Further still, such heating can be localized to those valves that are intended to be operated during a cold start.

The above advantages and other advantages, and features of the present description will be readily apparent from the following Detailed Description when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
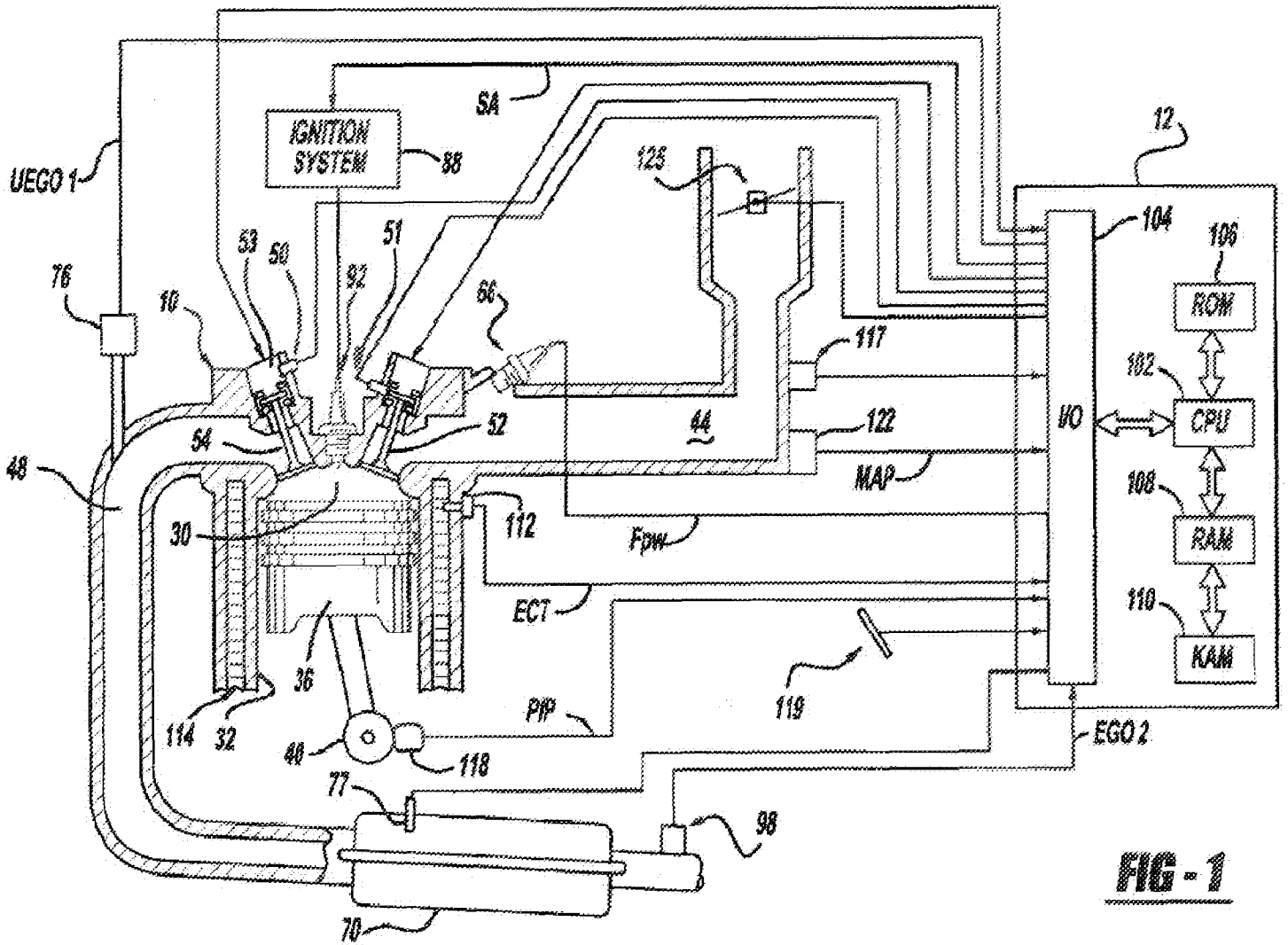
FIG. 1 is a schematic diagram of an engine and its control system.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is known communicating with intake manifold 44 and exhaust manifold 48 via respective intake valve 52 an exhaust valve 54. Each intake and exhaust valve is operated by an electromechanically controlled valve coil and armature assembly 53. Alternatively, intake valves may be operated by electrically operable mechanically actuated valves while the exhaust valves are operated by mechanically driven valves. In still other alternatives, other combinations of mechanical and electromechanical valves may be used. For example, a portion of intake valves may be mechanically driven while other intake valves are electrically actuated. Armature temperature may be determined from temperature sensor 51 or may be inferred from a single sensor, such as an engine coolant temperature sensor 112. Valve position is determined by position sensor 50 located internal to assembly 53. In an alternative example, each valves actuator for valves 52 and 54 has a position sensor and a temperature sensor. In yet another alternative example, armature temperature may be determined from actuator power consumption since resistive losses scale with temperature.

Intake manifold 44 is also shown having fuel injector 66 coupled thereto for delivering liquid fuel in proportion to the pulse width of signal FPW from controller 12. Fuel is delivered to fuel injector 66 by fuel system (not shown) including a fuel tank, fuel pump, and fuel rail (not shown). Alternatively, the engine may be configured such that the fuel is injected directly into the engine cylinder, which is known to those skilled in the art as direct injection. In addition, intake manifold 44 is shown communicating with optional electronic throttle 125.

Distributorless ignition system 88 provides ignition spark to combustion chamber 30 via spark plug 92 in response to controller 12. Universal Exhaust Gas Oxygen (UEGO) sensor 76 is shown coupled to exhaust manifold 48 upstream of catalytic converter 70. Alternatively, a two-state exhaust gas oxygen sensor may be substituted for UEGO sensor 76. Two-state exhaust gas oxygen sensor 98 is shown coupled to an exhaust pipe 48 downstream of catalytic converter 70. Alternatively, sensor 98 can also be a UEGO sensor. Catalytic converter temperature is measured by temperature sensor 77, and/or estimated based on operating conditions such as engine speed, load, air temperature, engine temperature, and/or airflow, or combinations thereof.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, and read-only-memory 106, random-access-memory 108, 110 Keep-alive-memory, and a conventional data bus. Controller 12 is shown receiving various signals from sensors coupled to engine 10, in addition to those signals previously discussed, including: engine coolant temperature (ECT) from temperature sensor 112 coupled to water jacket 114; a position sensor 119 coupled to a accelerator pedal; a measurement of engine manifold pressure (MAP) from pressure sensor 122 coupled to intake manifold 44; a measurement (ACT) of engine air amount temperature or manifold temperature from temperature sensor 117; a engine position sensor from a Hall effect sensor 118 sensing crankshaft 40 position; and power driver circuitry capable of providing actuating energy to actuate valves as well as capability to provide current for heating valve actuators. In one aspect of the present description, engine position sensor 118 produces a predetermined number of equally spaced pulses every revolution of the crankshaft from which engine speed (RPM) can be determined.

In an alternative embodiment, a direct injection type engine can be used where injector 66 is positioned in combustion chamber 30, either in the cylinder head similar to spark plug 92, or on the side of the combustion chamber.

Figure 2:
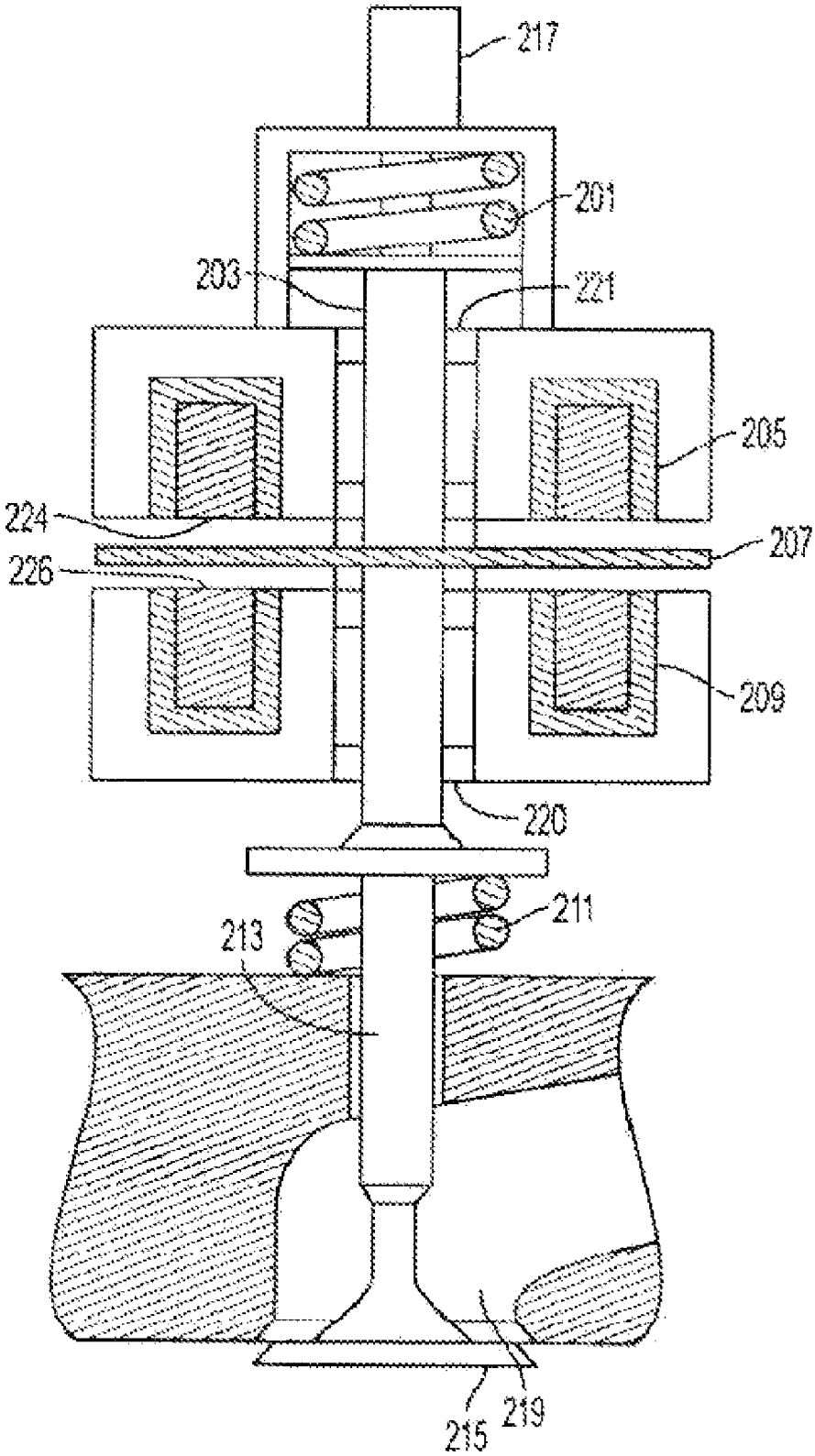
FIG. 2 is a schematic diagram of an electrically operable mechanical valve actuator that utilizes valve opening and closing coils that is shown in a neutral state.

Referring now to FIG. 2, a schematic of an example electrically operable mechanical valve actuator is shown. The actuator operates an internal combustion engine cylinder valve. And the valve actuator is shown in a de-energized state (i.e., no electrical current is being supplied to the valve actuator coils).

In one embodiment, an electromechanical valve is comprised of an armature assembly and a valve assembly. The armature assembly is comprised of an armature return spring 201, a valve closing coil 205, a valve opening coil 209, an armature plate 207, a valve displacement transducer 217, armature bushings 220 and 221, and an armature stem 203. When the valve coils are not energized the armature return spring 201 opposes the valve return spring 211, valve stem 213 and armature stem 203 are in contact with one another, and the armature plate 207 is essentially centered between opening coil 209 and closing coil 205. This allows the valve head 215 to assume a partially open state with respect to the port 219. When the armature is in the fully open position the armature plate 207 is in contact with the opening coil magnetic pole face 226. When the armature is in the fully closed position the armature plate 207 is in contact with the closing coil magnetic pole face 224. Note in one embodiment that the electrically operable mechanical valve actuator natural frequency may be determined from the mechanical portion comprising the actuator armature 203, plate 207, and return spring 201. While in other embodiments, the natural response may also include valve stem 213, valve head 215, and return spring 211 in the mechanical portion of the actuator. Alternatively, combinations or sub-combinations of the mechanical components of FIG. 2 may be used to determine a valve's natural frequency. Of course, other valve actuator designs having a range of natural frequencies are anticipated. Therefore, the illustrations in the present description are not intended to limit the scope or breadth of the description.

Figure 3:
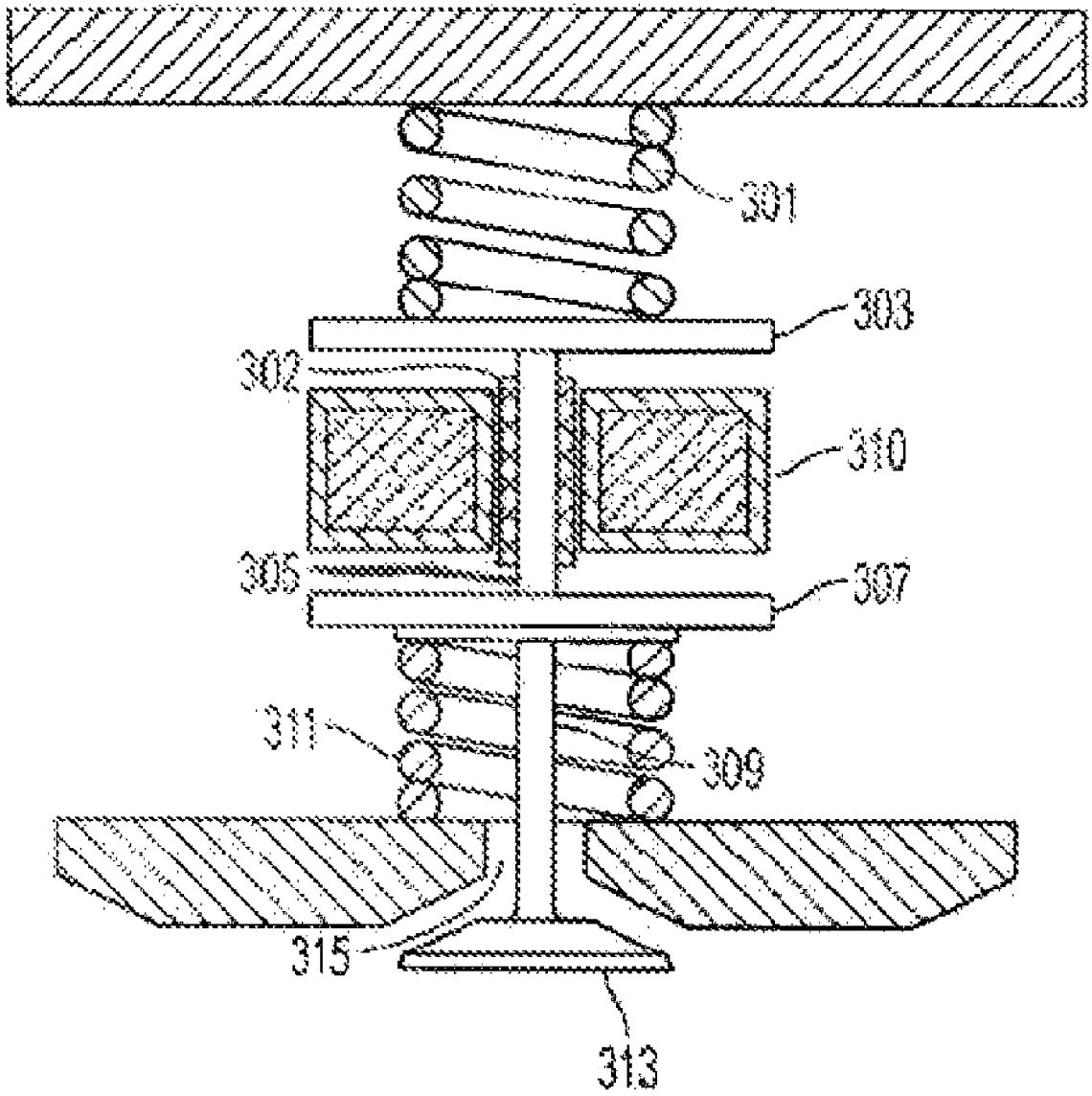
FIG. 3 is a schematic diagram of an alternate electrically operable mechanical valve actuator that utilizes a single coil to control valve opening and closing that is shown in a neutral state.

Referring now to FIG. 3, a schematic of an alternate example of an electrically operable mechanical valve is shown. The valve actuator is shown in a de-energized state (i.e., no electrical current is being supplied to the valve). The electromechanical valve is comprised of an armature assembly and a valve assembly. The armature assembly is comprised of an armature return spring 301, an armature opening plate 303, an armature closing plate 307, armature bushing 302, and an armature stem 305. When the valve armature is not energized the armature return spring 301 opposes the valve return spring 311, valve stem 309 and armature stem 305 are in contact with one another, and armature plates 303 and 307 are centered about coil 310. This allows the valve head 313 to assume a partially open state with respect to the port 315.

Referring now to FIG. 4, a plot of the free response of an electrically operable mechanical valve actuator at 90° C. is shown. The X-axis represents time in seconds. The Y-axis represents valve movement relative to the neutral valve position. Line 401 represents the trajectory of the valve actuator armature free response. Near time zero, a valve is released from an open position. The valve armature position oscillates around the neutral position and the amplitude decays linearly over time and approaches the neutral position at approximately 0.16 seconds.

Figure 4A:
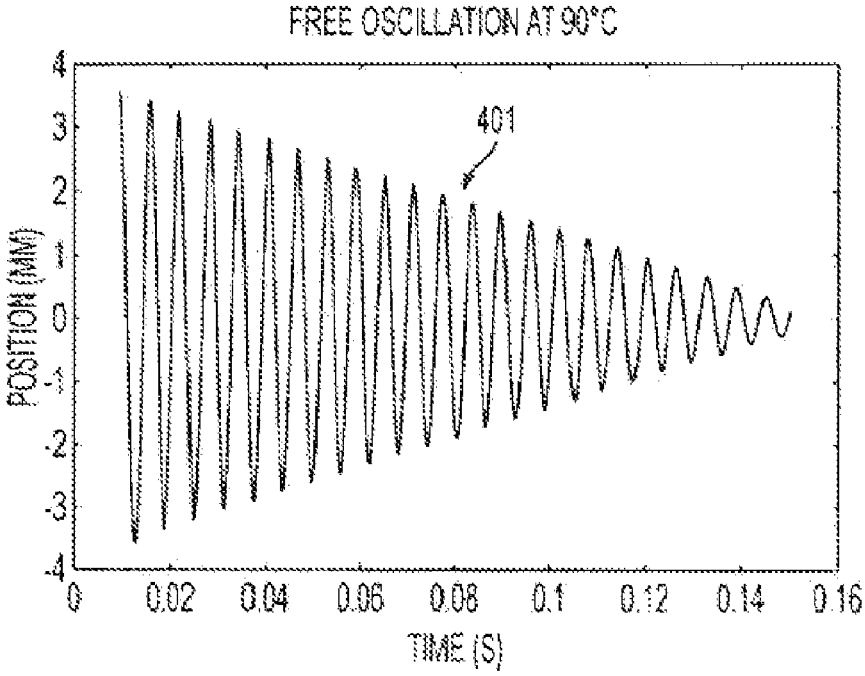
FIG. 4A is a plot that shows the response of an electrically operable mechanical valve actuator at 90° C.
Figure 4B:
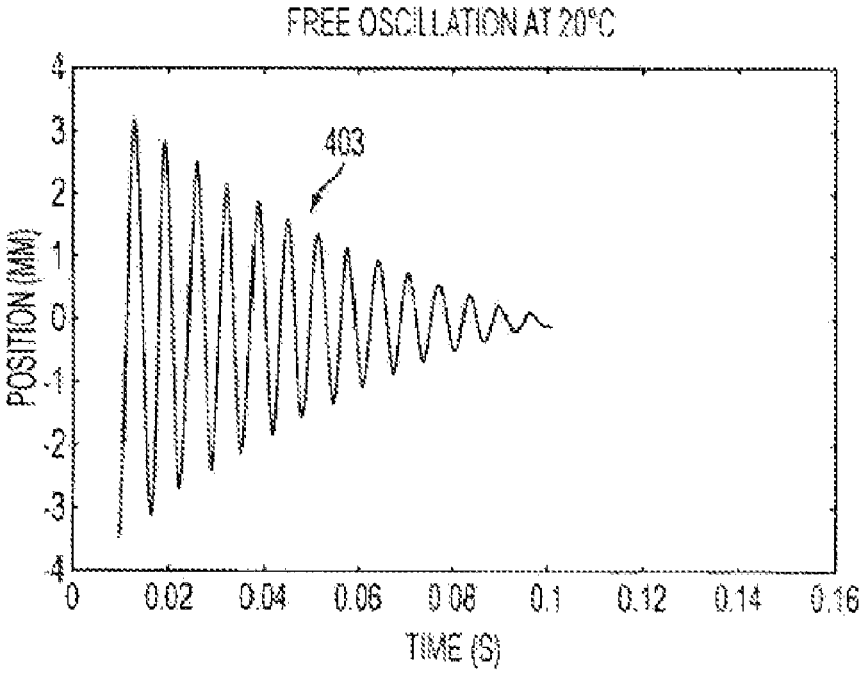
FIG. 4B is a plot that shows the response of an electrically operable mechanical valve actuator at 20° C.

Referring now to FIG. 4B, a plot of the free response of an electrically operable mechanical valve actuator at 20° C. is shown. The valve used in FIG. 4A is the same valve that is used in the illustration of 4B. Line 403 represents the trajectory of the valve actuator free response. The valve is released from a closed position and oscillates around the neutral position. However, the valve response rate of decay increases for the conditions illustrated in FIG. 4B. Specifically, the valve assumes the neutral position at approximately 0.1 seconds rather than the 0.16 seconds shown in FIG. 4A. Further, the rate of decay is exponential rather than linear.

Comparing the response of FIG. 4A to the response of FIG. 4B, it becomes apparent that there are temperature dependent losses that effect valve operation. A large portion of these losses can be attributed to the effect that temperature has on the viscosity of lubricating substances. In one example, the lubricating substance is engine oil. When oil temperature is decreased, the viscosity of oil increases and friction losses between the valve armature and the valve actuator bushings increases. By heating electrically operable mechanically actuated valves, lubricating oil viscosity can be lowered, thereby lowering valve friction and improving valve response when an engine is operated at lower ambient temperatures.

Figure 5:
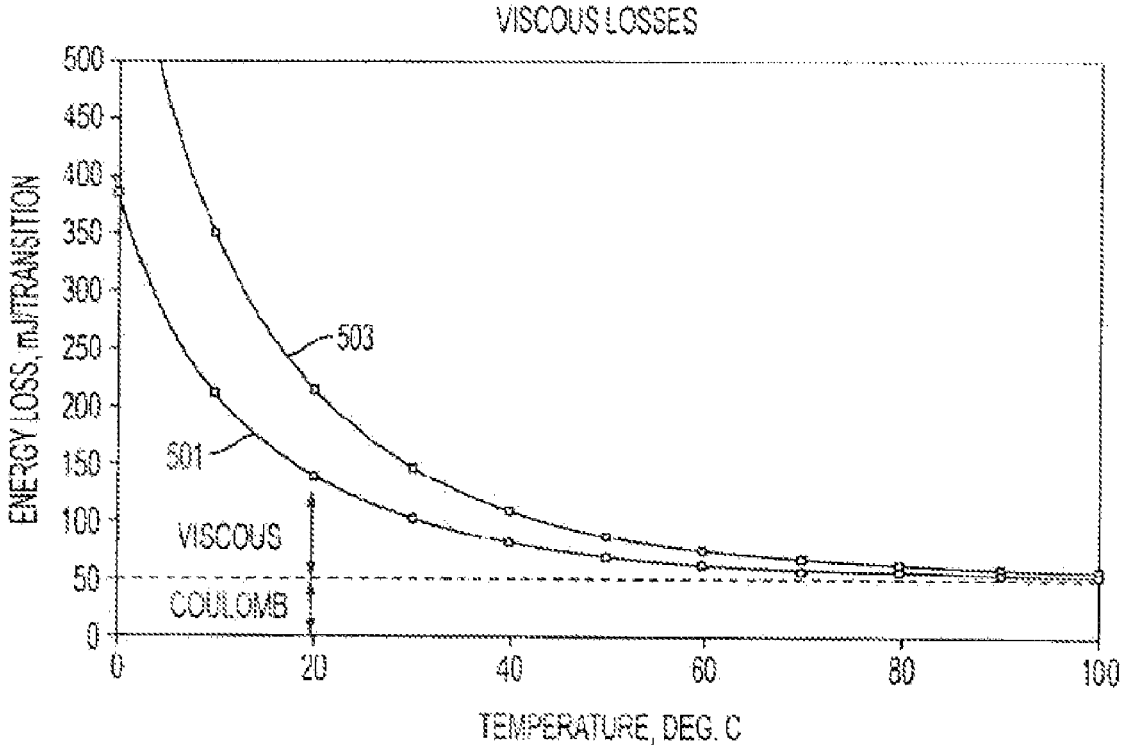
FIG. 5 is a schematic diagram that shows energy loss as a function of temperature for an example electrically operable mechanical valve actuator.

Referring now to FIG. 5, a plot of viscous losses for an electrically operable mechanically actuated valve are shown.

The X-axis represents temperature measured in degrees Celsius. The Y-axis represents the amount of energy lost during a transition from one valve state to the other. The Y-axis units are milli-Joules per transition.

Curve 501 represents energy losses for an electrically operable mechanical valve actuator with a first clearance between the actuator armature and the armature guides. Curve 503 represents energy losses for an electrically operable mechanical valve actuator with as second clearance between the actuator armature and the armature guides. The clearance between the armature and valve guides is greater for the valve described by curve 501. From the plots, it is apparent that the lubricating oil viscosity affects valve resistance differently for dissimilar bushing/armature clearances. Specifically, at warmer temperatures, the valve losses are nearly identical. But, as the temperature is lowered, a difference in the energy losses of different clearance valves appears.

These temperature dependent valve losses can be mitigated by heating valves and moving the valve operating point from left side of the plot toward the right side of the plot. Thus, the variation of losses between valves can be reduced, and the overall losses of the respective valves can be reduced. Consequently, valve operation can be improved when an engine is operated during colder conditions.

Figure 6:
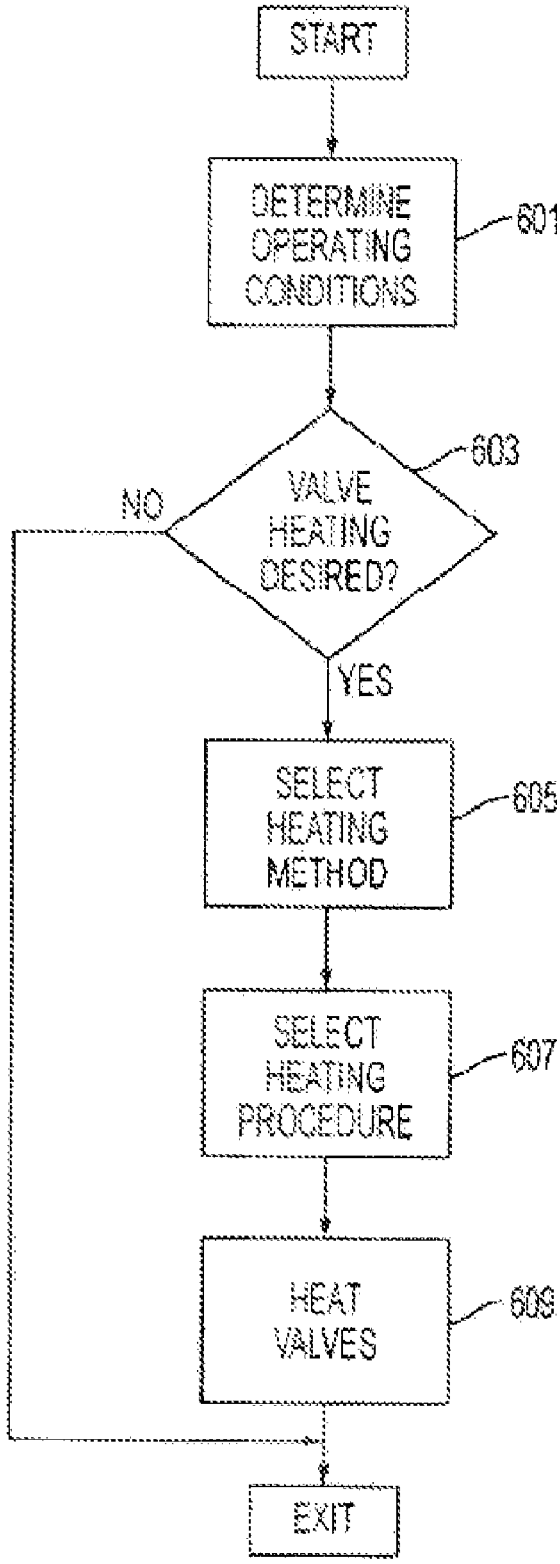
FIG. 6 is a flow chart that shows an example method for heating an electrically operable mechanical valve actuator.

Referring now to FIG. 6, a flow chart of an example valve heating strategy is shown. After an internal combustion engine is stopped, the temperature of the engine and its components move toward the ambient temperature. This can cause the viscosity of oil and characteristics of other materials in an internal combustion engine to change. For example, the friction losses may increase as temperatures are lowered. As a result, the amount of energy necessary to rotate the engine when the engine is restarted may increase. Likewise, if the friction losses of an electrically operable component increase with decreasing temperature, the amount of electrical energy used to operate the component may have to be increased. One way to reduce the friction losses of a lubricated component is to raise the temperature at or near the lubricated surfaces that interact. By increasing the temperature in this region, the lubricating oil viscosity can be reduced and the friction lowered. FIG. 6 illustrates an example method for reducing electromechanical valve oil viscosity.

Returning now to FIG. 6, in step 601, operating conditions are determined. Operating conditions are determined by inquiring into the status of sensors described in FIG. 1. That is, the output of a sensor and/or actuator is sampled and operating conditions are determined. Furthermore, sensor information can be used to infer operating conditions of unmonitored engine conditions. In one embodiment, engine oil temperature, engine coolant temperature, valve actuator temperature, and ambient air temperature are determined and exhaust temperature is inferred. Other embodiments may determine engine speed, time since start, engine combustion events from a start, valve temperature, and/or engine load, for example. In addition, combinations and sub-combinations of the above variables may be determined depending on design choice. The routine proceeds to step 603.

In step 603, the routine determines if heating of an electrically operable mechanically actuated valve is desired. If so, the routine proceeds to step 605, if not the routine proceeds to exit. If heating is not desired, the valves can be supplied with current that provides typical opening and closing functionality.

The determination of whether or not to heat an electromechanical valve can be based on one or more operating conditions of an engine, the time since the engine was last started, and/or operator input. In one embodiment, a vehicle door opening or unlock signal and engine coolant temperature can be used to determine if electromechanical cylinder valve heating is desired. If the engine coolant temperature is above a predetermined level valve heating is bypassed. To make this determination, the engine coolant temperature can be used to index a table or function of empirically determined heating times. In one example, the desired valve heating time increases as the engine oil temperature decreases. And as the coolant temperature approaches operating temperature the heating time goes to zero. Thus, in one embodiment, current applied to an actuator coil can be controlled to increase a magnetic field strength, eddy currents, and hysteresis losses when valve temperature decreases, and the current can be controlled to reduce a magnetic field strength, eddy currents, and hysteresis losses when the temperature increases. In another embodiment, engine coolant temperature can be used to determine the valve heating duration. In still other embodiments, combinations and sub-combinations of parameters determined in step 601 can be used to determine valve heating time.

Once valve heating begins, the valves may be heated for a predetermined amount of time, a number of cylinder combustion events, or until a predetermined valve temperature is determined (i.e., measured or inferred).

In step 605, the valve heating method is selected. The electrically operable mechanically actuated valves may be heated by eddy currents, hysteresis, coil resistance, or by a combination of eddy current, hysteresis, and resistance heating.

Eddy current and hysteresis heating methods provide a way to project electrical energy away from the actuator coils. Further, the actuator coils are also heated during eddy current and hysteresis heating. That is, a time-varying current can be supplied to a coil to produce a time-varying magnetic field that induces eddy currents and hysteresis in nearby conductive components while also creating $I^2R$ losses. Eddy current heating, hysteresis heating, and the $I^2R$ losses can be adjusted by varying the current offset from zero, the current amplitude, and the current frequency.

Eddy currents generate heat when they are resisted by the conductive components. The time-varying current may be bi-polar or uni-polar and may driven by an applied voltage that takes the form of a square wave, a sine wave, or a triangle wave, for example. And the magnetic field frequency and power density can be controlled to target specific areas of the surrounding conductive valve components by adjusting the time-varying current. For example, higher frequency coil excitation current tends to concentrate eddy current at the outer surface of conductive components while lower frequencies tend to penetrate deeper into the component. By exciting the actuator coil at higher frequencies, the valve actuator armature outside surface area temperature can be increased so that the oil film that lubricates the armature is heated. Heating the transmission fluid film can locally decrease the fluid viscosity and lower the valve actuator friction. The current to the actuator coil can be controlled by a model that predicts component temperature, from component temperature measurement feedback, or from a combination of temperature feedback and model data. Thus, the current attributes (i.e., frequency, amplitude, duty cycle, etc.) can be adjusted to produce a time-varying magnetic field having a power density that substantially raises the temperature of an armature of an electrically operable mechanical valve in a transmission (e.g., in some applications a power density that increases the initial temperature 10% over a 10 second period; in other examples, a power density that increases the initial temperature 1° C., 5° C., or 10° C. over a 10 second period; in other applications a power density that increases the initial temperature 10% over a 20 minute interval may be desirable depending on actuator mass, ambient conditions, and control objectives). And the current attributes can be adjusted to increase the magnetic field power density at lower temperatures and to decrease the magnetic field power density at higher temperature. Consequently, eddy current heating and hysteresis heating can be controlled so that actuator heating is varied in response to engine and/or valve operating conditions.

Hysteresis heating can result from losses that occur in magnetic materials. A time-varying magnetic field can cause magnetic dipoles in magnetic material to oscillate as the magnetic poles change orientation in response to the time-varying magnetic field. The oscillating dipoles can produce heat unless the material is heated above the Curie temperature.

Eddy current and hysteresis heating also allows the valve actuator armature and the poppet valve to substantially remain in a position (e.g., ±0.2 mm) that the armature/poppet valve assumes before eddy current heating is initiated. That is, the actuator armature and poppet valve can be held in a position (open or closed) or be in a neutral position while using eddy current and/or hysteresis for heating a valve actuator without moving the actuator. By supplying current at a frequency that is above the natural frequency of the mechanical system, the electrical current energy can be transformed into magnetic field energy without necessarily moving the valve actuator armature or poppet valve. Note that the mechanical system in some configurations can be the valve actuator, while in other systems the mechanical system can include the poppet valve and associated components and springs.

Alternatively in a different embodiment, current can be supplied at a frequency having a period that is less than the transit time that it takes for an electrically operable mechanical actuator being excited to move its armature from an open to a closed position, or vise-versa, at a particular current level. For example, where a current amount at a first level moves an armature in 0.2 seconds, a current frequency greater than 5 Hz can be applied. At another condition, where a current amount at a second level moves the previously mentioned armature in 0.1 seconds, a current frequency greater than 10 Hz can be applied. By exciting the electrically operable mechanical valve with a current at a frequency above the transit time, eddy current heating and hysteresis heating can be applied without having to move the actuator armature.

While AC currents provide resistive, eddy current, and hysteresis heating, DC currents provide only resistive heating which increases temperature of an actuator coil so that coil heat can be carried to surrounding components by conduction. In this heating mode, current flowing into the valve actuator coil is regulated so that the actuator coil temperature stays below a predetermined value. The coil temperature can be controlled by regulating the amount of current entering the actuator coil as well as by controlling the amount of time that current is permitted to flow into the actuator coil. Valve heating current may controlled by a model that predicts component temperature, from component temperature measurement feedback, or from a combination of temperature feedback and model data. In one embodiment of resistive coil heating, the valve actuator armature and the engine poppet valve are substantially maintained in a position (i.e., ±0.2 mm) that the intake or exhaust poppet valve assumed prior to increasing or decreasing current to the electrically operable mechanical valve actuator a plurality of times. For example, current may be increased and decreased a plurality of times to an intake or exhaust valve that is in a full open or full closed position to heat a valve actuator by resistive heating. In another embodiment, it is also possible to simultaneously apply current to opening and closing coils of a particular valve actuator while the valve actuator armature and poppet valve remain in substantially the same position (e.g., open, closed, or neutral position) that they assumed prior to the current being increased and decreased a plurality of times.

The combination of AC and DC currents can be used to control the individual heating components (i.e., resistive, eddy current, and hysteresis heating). One way to combine resistive and eddy current heating is to supply current that has an average value greater than zero and having a frequency that is above the valve's natural frequency. That is, the time-varying current is off-set from zero. This method can be used to raise the actuator coil temperature and to generate eddy currents in surrounding metallic components. As a result, two sources of heat may be used to heat an electrically operable mechanically actuated valve.

It may be desirable to use one heating method over another. For example, at lower temperatures it may be desirable to use the combination of eddy current and resistive heating. This method can be used to heat a metallic armature and a non-metallic bushing, for example. The eddy current heating can target energy to the armature surface where oil is in contact with the armature, while heat from the actuator coil can be used to warm a non-metallic bushing. In this way, it is possible to warm the interface between the bushing and armature from both sides of the interface.

In other circumstances, it may be just as desirable to primarily use eddy current heating. For example, if a particular electromechanical valve design is such that heat is not readily conducted from the actuator coil to an area where heat is desired, then it may be desirable to simply heat the valve by eddy currents and/or hysteresis. In still another embodiment, a valve armature may be constructed so that eddy currents in the armature shaft are reduced. In this circumstance, it may be more desirable to heat the armature by conducting heat that is generated from coil resistance.

The particular desired heating method can be selected by logically evaluating operating conditions. In one embodiment, the valve heating method is determined by engine coolant temperature and battery state of charge. If the engine coolant temperature and the battery state of charge are within one range, eddy current valve heating is initiated. If engine coolant temperature and battery state of charge are within a different range, resistive heating is initiated. In another embodiment, a state machine can be used to select the desired heating method. Engine operating conditions and valve operating conditions determine a particular heating state that is initiated.

Also note that it is possible to heat the valves while the engine is stationary or while the engine is being operated. Resistive heating can be accomplished by increasing current flow above the amount of current necessary to hold a valve in a desired position. For example, when a valve is closed, additional current may be sent to a coil so that the coil temperature increases while the valve is in the closed state. When the valve is moved to the open state, current may be increased to the opening coil so that the opening coil heats the actuator armature.

It is also possible to initiate eddy current heating in opening and closing coils of a particular valve actuator simultaneously. Since a large portion of the energy entering the actuator coils produces heat energy, the actuator armature can remain substantially stationary while two opposed coils are heating the actuator armature. These features and others are illustrated in FIGS. 7 and 8.

In step 607, the valve heating procedure is selected. In some embodiments, valve heating can be completed before an engine is allowed to be cranked over (i.e., rotated from a stop position). Further, valve heating may be set to occur before attempting to move the valves to a position for engine starting. In another embodiment, valves may be moved to a position for engine starting and then heated. For example, an intake valve can be moved to a closed position and heated. In still other embodiments, the engine may be allowed to rotate while the valves are being heated. Thus, the valves may be heated in a variety of ways. In one embodiment, engine operating conditions are evaluated with logic and a particular heating method is selected. For example, in one embodiment, when a vehicle door is opened, eddy current heating may be initiated in a valve opening coil to reduce the valve friction. In another embodiment, resistive heating is used when engine coolant temperature is above a predetermined amount and the combination of resistive and eddy current heating is used when the engine coolant temperature is below a predetermined amount. Since valve design and system construction may vary from application to application, a variety of heating selection procedures are anticipated. As such, the heating procedures mentioned are not meant to limit the description scope or breath.

In step 609, the electromechanically actuated valves are heated. One or more electrically operable mechanically actuated valves are heated by supplying current to one or more coils of an electrically operable mechanically actuated valve. The current may be supplied continuously or it may be supplied in discrete intervals. For example, it may be desirable during some conditions to supply current to one actuator coil, stop current flow to the coil, and then start current flowing to another cylinder. This sequence may be implemented for each cylinder of a multi-cylinder engine. By supplying current to each coil sequentially, the instantaneous power consumption may be reduced. Furthermore, if current is controlled so that current begins to flow in one coil before current flow is stopped to another cylinder, then energy stored in one coil can be used to power the other coil. FIGS. 7 and 8 provide examples of the method described in FIG. 6. The routine proceeds to exit.

Figure 7:
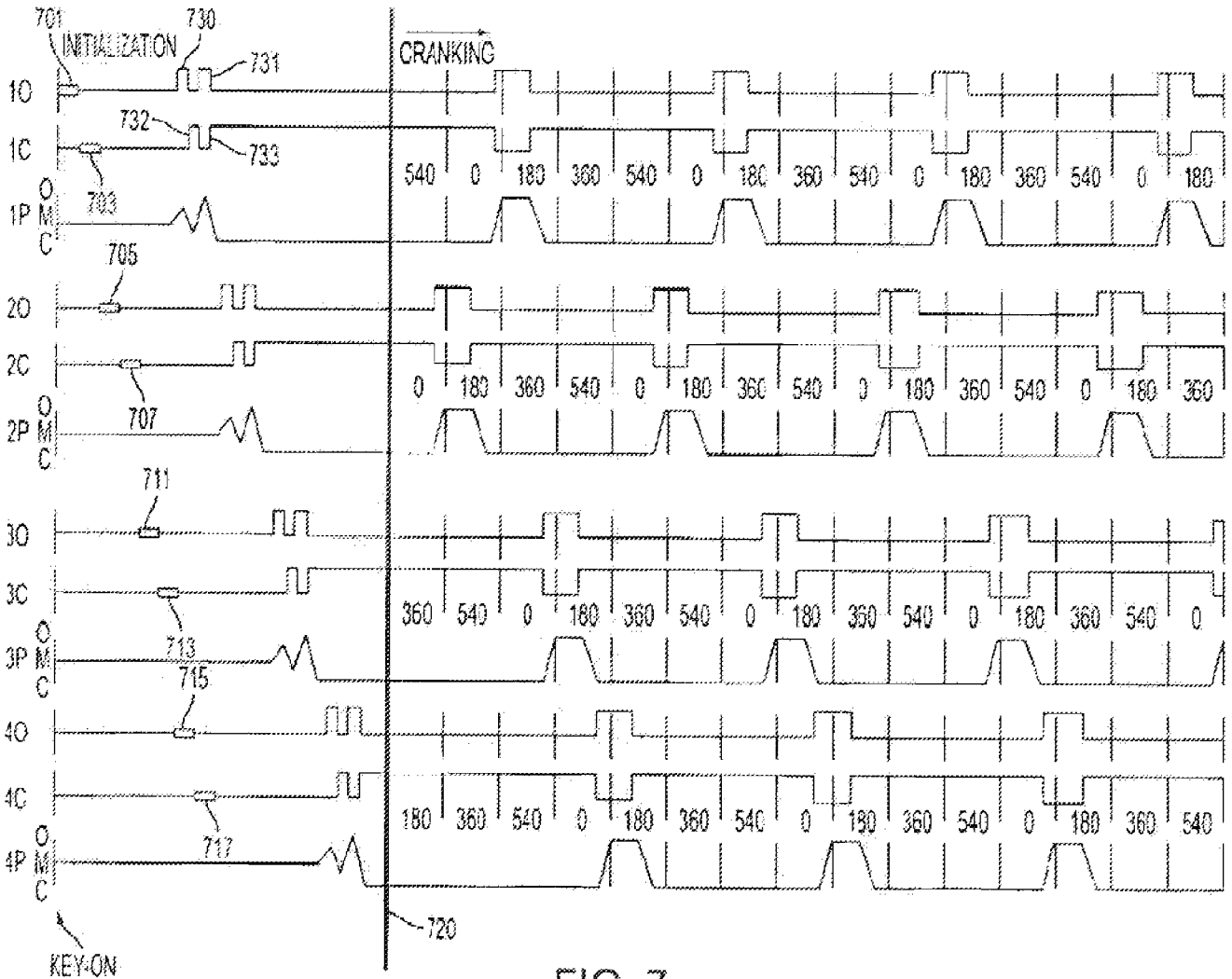
FIG. 7 is a schematic diagram of an example heating sequence for an electrically operable mechanical valve actuator.
Figure 8:
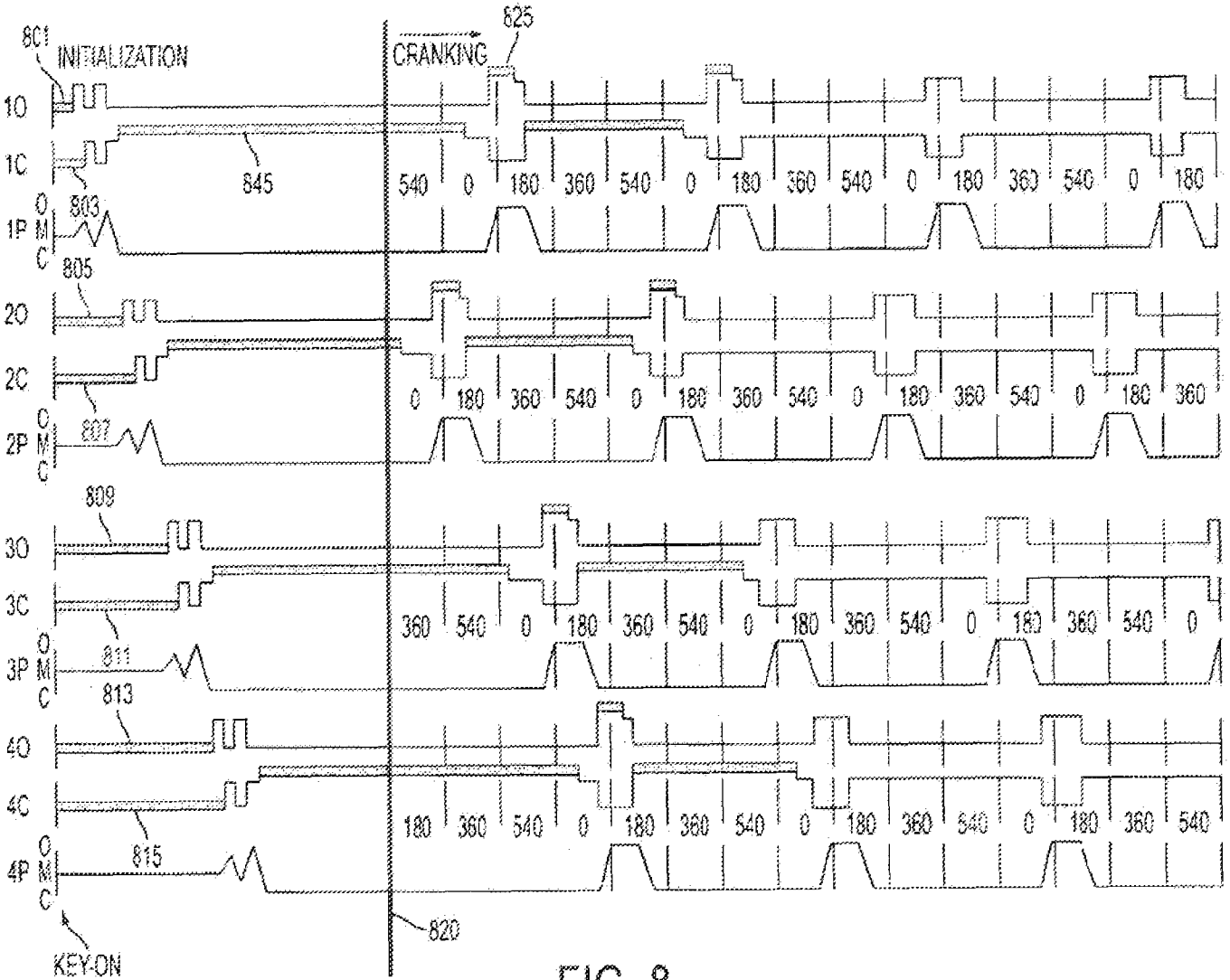
FIG. 8 is a schematic diagram of another example heating sequence for an electrically operable mechanical valve actuator.

Referring to now FIG. 7, a schematic of a heating sequence for an electrically operable mechanical valve actuator is shown. The figure shows example valve control signals for intake valves of a four cylinder engine. Opening coil signals are labeled 1O-4O. Closing coil signals are labeled 1C-4C. Respective valve positions are indicated by signals 1P-4P. A low level actuator signal indicates little or no current flow to an actuator, and a high level indicates that current is flowing to the actuator. However, where actuator signals are indicated by wide lines (e.g., 701-717) current is flowing to the actuator coil in an amount that can produce a desired level of actuator heating. Of course, the current amount used for heating can vary with operating conditions and valve design. Vertical marker 720 represents the beginning of engine cranking. The engine is represented not rotating to the left of marker 720, and the engine is represented as rotating to the right of marker 720. Numbers representing the relative position of each piston are displayed below each closing coil signal. The numbers correspond to the markers to the right of each number. The numbers represent the number of engine degrees from top-dead-center compression stroke of each respective cylinder. The signal areas shown in wide lines (e.g., 701, 703, 705, 707, and alike) represent intervals of eddy current and/or hysteresis heating by the coil; however, the line thickness is not an indication of current frequency or amplitude. The current frequency and amplitude can be varied as the amount of heat desired and the heating location vary.

Interval 701 represents valve heating by the opening coil of cylinder number one intake valve actuator. During a coil heating interval, coil current may change at a frequency that is greater than the valve's natural frequency and such that the current power density is sufficient to substantially change the valve actuator temperature (e.g., in some applications a power density that increases the initial temperature 10% over a 10 second period; in other examples, a power density that increases the initial temperature 1° C., 5° C., or 10° C. over a 10 second period; in other applications a power density that increases the initial temperature 10% over a 20 minute interval may be desirable depending on actuator mass, ambient conditions, and control objectives). By controlling coil current in this way, valve actuators can be heated substantially by eddy currents and hysteresis without moving the valve actuator armature. Consequently, a large amount of power entering an actuator coil can be directed to the production of heat in the actuator armature without having to move the armature or heat the actuator coil.

In this sequence, the coils and valves are sequentially heated. That is, the heating process begins in one coil before beginning in another coil. However, in another embodiment, the intervals that coil heating current is delivered to two different coils will overlap, while in other embodiments, the intervals that coil heating current is delivered will be separated by a short period of time. Heating intervals 701, 703, 705, 707, 711, 713, 715, and 717 are shown for illustration purposes and actual heating intervals can vary in length depending on a particular desired heating sequence. For example, heating sequences 701, 703, 705, 707, 711, 713, 715, and 717 can range in time from microseconds to minutes. Further, the sequential heating process that occurs before marker 720 can be repeated as many times as desired before the engine is allowed to start or before an operator is given a signal to proceed, for example.

Initially, each electrically operable mechanical valve actuator is left in a neutral position while an engine is stopped. By letting the valves assume a neutral position, power is conserved during engine stops. One way to prepare an engine to start is to pull the actuator armature between opening and closing coils until the valve can be captured in the desired position (i.e., open or closed). This method is illustrated for valve number one by current pulses 730-733. The same method is illustrated for valves 2-4. However, it can be desirable to heat the electrically operable mechanically actuated valve prior to setting the valve to an open or closed position. By first heating the valve, less energy may be required to position the valve for an engine start. At heating intervals 701, 703, 705, 707, 711, 713, 715, and 717, eddy current and/or hysteresis heating is applied to the opening and closing coils. Alternatively, heating may be limited to a single coil (i.e., the opening or closing coil) rather than being delivered to both coils, if desired. Further, since the valve can be heated with eddy currents while maintaining the valve state (i.e., open or closed), other embodiments are envisioned where the valves are heated after being positioned. Further still, eddy current heating may be simultaneously initiated in the opening and closing coil of a valve actuator. And eddy current valve heating can be accomplished while the valves are being operated. Therefore, an electrically operable mechanically actuated valve can be brought to a desirable operating temperature quicker than if the valve temperature is raised using friction heating.

Note that electrically operable mechanically actuated exhaust valves may be heated in a similar manner. Further, for cylinders that have more than a single intake valve, other intake valves may likewise be heated.

Referring now to FIG. 8, another example of valve actuator heating is shown. Signals in FIG. 8 follow the same naming convention as those illustrated in FIG. 7.

In one embodiment, the valve opening and closing coils are supplied with a time-varying current from the key-on indication. The valve heating period may vary with operating conditions (i.e., engine and/or actuator conditions) Alternatively, valve heating may be initiated by the opening of a door or by some other method, a door unlock command for example. Further, the coils may receive additional heating at this time by applying an offset to the time-varying signal, or the time-varying signal can be omitted and a substantially constant current (e.g., a current that varies less than ±0.5 ampere) can be used to heat the coils. The valves are sequentially set to a desired position so that vehicle power may be conserved.

After the valves are set to a closed position, the average amount of current can be increased so that the coil temperature begins to increase. This is illustrated by the current identified by marker 845. This example illustrates one embodiment of eddy current and resistive valve actuator heating. In other embodiments, valves may be heated while in an open position. Further, both coils of a single valve actuator may be supplied current simultaneously so that heat is produced by eddy currents and by resistance. The resistive heat increases when the supplied coil current is greater than the current necessary to hold a valve in a position. That is, current exceeding the holding current is supplied to the coil so that the coil temperature is increased.

In one embodiment, the eddy current and resistive heating continues after the engine begins to rotate. In the figure, resistive heating is illustrated while the valve is in an open or closed position and occurs in the coil that holds the valve in position. For example, marker 825 shows holding current at a first level and then dropping to a second level for the valve opening command. However, it is also possible to increase current to the coil that is opposite to the holding coil, so that heat is increased in the coil that is not presently controlling the valve position. In still other embodiments, current can be supplied to a coil of an actuator for resistive heating and eddy current heating, while current supplied to the other actuator coil may be controlled to supply heat by mostly eddy currents.

As will be appreciated by one of ordinary skill in the art, the routines described in FIG. 6 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A system to improve the performance of an electrically actuated poppet valve operable in an internal combustion engine, the system comprising:

a first mode of operation including supplying an electrical current to at least a coil of the electrically actuated poppet valve, said current increasing eddy current in said electrically actuated poppet valve when a temperature is decreasing, and said current decreasing eddy current in said electrically actuated poppet valve when a temperature is increasing, said current at a frequency having a period that is less than a transit time necessary to move an armature of said electrically actuated poppet valve from an open position to a closed position, said current applied while said internal combustion engine is rotating;

a second mode of operation including supplying an electrical current to actuate said electrically actuated poppet valve; and a controller to select between said first mode and said second mode in response to at least an operating condition.

2. The system of claim 1 wherein said first mode of operation is during an engine start.

3. The system of claim 1 wherein said temperature is an engine temperature.

4. The system of claim 1 wherein said temperature is a temperature of said electrically actuated valve.

5. The system of claim 1 wherein said operating condition is a time since said internal combustion engine was last started.

6. The system of claim 1 further comprising selecting between said first mode and said second mode based on operating condition of said electrically operated poppet valve.

7. A method to improve the performance of an electrically operable valve actuator, the electrical valve actuator operating a valve of an internal combustion engine cylinder, the method comprising:

applying current to the electrically operable valve actuator that operates the valve of the internal combustion engine;

said current having attributes at a level sufficient to produce a time-varying magnetic field having a power density that substantially raises a temperature of an armature of said electrically operable valve actuator, while substantially maintaining an operating state that said electrically operable valve actuator assumed prior to applying said current;

opening or closing said valve by operating said electrically operable valve actuator;

supplying a time-varying current to said electrically operable valve actuator while substantially maintaining the operating state of said electrically operable valve actuator when said valve is in an open or a closed position; and varying a frequency or amplitude of said time-varying current while said internal combustion engine is rotating.

8. The method of claim 7 wherein said valve of said internal combustion engine is an intake or exhaust valve.

9. A method to improve the performance of an electrically actuated poppet valve operable in an internal combustion engine, the method comprising:

a first mode of operation wherein a time varying electrical current is supplied to at least a coil of the electrically actuated poppet valve, said electrical current increasing eddy current in said electrically actuated poppet valve by adjusting a frequency or amplitude of said electrical current when a temperature is decreasing, and said current decreasing eddy current in said electrically actuated poppet valve by adjusting the frequency or amplitude of said electrical current when the temperature is increasing, said electrical current at a level that allows an armature of said electrically actuated poppet valve to substantially remain in a position;

a second mode of operation wherein an electrical current is supplied to actuate said electrically actuated poppet valve; and selecting between said first mode and said second mode in response to at least an operating condition.

10. The system of claim 9 wherein said first mode of operation is during an engine start.

11. The system of claim 9 wherein said temperature is an engine temperature.

12. The system of claim 9 wherein said operating condition is an operating condition of said electrically operated poppet valve.

13. The system of claim 9 wherein said temperature is a temperature of said electrically actuated valve.

14. The system of claim 9 wherein said operating condition is a time since said internal combustion engine was last started.

* * * * *